US007832656B2

(12) United States Patent
Matteucci et al.

(10) Patent No.: US 7,832,656 B2
(45) Date of Patent: Nov. 16, 2010

(54) FLUID INJECTOR AND METHOD FOR MANUFACTURING A FLUID INJECTOR

(75) Inventors: Luca Matteucci, Pisa (IT); Raffaele Squarcini, Leghorn (IT)

(73) Assignee: Continental Automotive GmbH, Hannover (DE)

( * ) Notice: Subject to any disclaimer, the term of this patent is extended or adjusted under 35 U.S.C. 154(b) by 473 days.

(21) Appl. No.: 10/597,513

(22) PCT Filed: Nov. 22, 2004

(86) PCT No.: PCT/EP2004/053043

§ 371 (c)(1),
(2), (4) Date: Jul. 10, 2008

(87) PCT Pub. No.: WO2005/075816

PCT Pub. Date: Aug. 18, 2005

(65) Prior Publication Data

US 2008/0257990 A1 Oct. 23, 2008

(30) Foreign Application Priority Data

Jan. 29, 2004 (EP) ..... 04001999

(51) Int. Cl.
*F02D 1/06* (2006.01)

(52) U.S. Cl. ..... 239/5; 239/102.2; 239/533.4; 239/533.7; 239/584; 239/600; 239/DIG. 4; 277/591

(58) Field of Classification Search ..... 239/5, 239/102.2, 533.4, 533.7, 533.9, 533.12, 584, 239/600, DIG. 4; 277/591, 598
See application file for complete search history.

(56) References Cited

U.S. PATENT DOCUMENTS

| | | | | |
|---|---|---|---|---|
| 2,986,342 | A | 5/1961 | Dahl | 239/453 |
| 4,720,077 | A * | 1/1988 | Minoura et al. | 239/102.2 |
| 4,726,523 | A * | 2/1988 | Kokubo et al. | 239/102.2 |

(Continued)

FOREIGN PATENT DOCUMENTS

| | | | |
|---|---|---|---|
| JP | 2002523672 | T | 7/2002 |
| JP | 2002540342 | T | 11/2002 |
| WO | 03/016707 | A1 | 2/2003 |

OTHER PUBLICATIONS

European Search Report for European Application No. 04001999.4-2311 (3 pages), Apr. 26, 2004.
International Search Report and Written Opinion for International Application No. PCT/EP2004/053043 (9 pages), Feb. 11, 2005.

*Primary Examiner*—Steven J Ganey
(74) *Attorney, Agent, or Firm*—King & Spalding L.L.P.

(57) ABSTRACT

A fluid injector has a housing, a valve body and an actuator unit inserted into the housing. The valve body has a cartridge with a recess that takes in a needle. The valve body further has a hollow body arranged in a fixed position to the needle and forming a first spring rest. The valve body further has a valve cap, which takes in the cartridge and forms a second spring rest. A return spring rests on the first spring rest and on the second spring rest. The valve cap, the housing and the cartridge are formed such, that before the valve cap and the housing and the valve cap and cartridge are permanently fixed to each other the valve cap is moveable relative to the housing and the cartridge while the housing and the cartridge stay in a fixed position relative to each other.

13 Claims, 3 Drawing Sheets

U.S. PATENT DOCUMENTS 6,247,453 B1 6/2001 Potschin et al.
6,467,460 B1 10/2002 Stier
6,676,030 B2 * 1/2004 Lorraine et al. ..... 239/5
2002/0027170 A1 3/2002 Popp ..... 239/132.5

* cited by examiner

FLUID INJECTOR AND METHOD FOR MANUFACTURING A FLUID INJECTOR

CROSS-REFERENCE TO RELATED APPLICATIONS

This application is a U.S. national stage application of International Application No. PCT/EP2004/053043 filed Nov. 22, 2004, which designates the United States of America, and claims priority to European application number EP04001999.4 filed Jan. 29, 2004, the contents of which are hereby incorporated by reference in their entirety.

TECHNICAL FIELD

The invention relates to a fluid injector and a method for manufacturing a fluid injector. Known fluid injectors comprise a housing, a valve body and an actuator unit, which is inserted into the housing. The valve body comprises a cartridge with a recess, that takes in a needle. A pretensioned spring rests on a body, that is fixed to the needle. The pretensioned return spring rests, on the other hand, on a spring rest which is formed in the valve body. In addition to that the actuator unit acts on the needle. Depending on the force balance of the actuator unit and the return spring the needle opens or closes a nozzle and in that way controls the injection of fuel. In an increasing number of applications actuator units with a piezoelectric actuator are used. They have the advantage of having a very fast response time to actuating signals and like that enable multiple injections into a cylinder of the internal combustion engine during one working cycle of the cylinder.

BACKGROUND

WO 03/016707 A1 discloses a fluid injector with a connector to a fuel supply, a housing, an actuator unit, and a valve body. The housing is double tubed and has a recess, which takes up the actuator unit. The actuator unit comprises a piezoelectric actuator, which acts on the needle. Between the walls of the double tube-shaped housing the fuel is led from the connector to a fuel inlet of the valve body. The valve body has a housing part with a recess, that takes up a needle. Depending on the position of the needle a nozzle is opened or closed and respectively fuel is injected or not.

Increasingly strict legislation concerning emissions of internal combustion engines, where a fluid injector may be arranged, make it necessary to put a lot of effort in measures that reduce the emissions. Very important for the prevention of exhaust emissions is, that the fluid can be dosed precisely.

SUMMARY

The object of the invention is to create a fluid injector and a method for manufacturing the fluid injector, which in a simple way enables to calibrate the fluid injector.

The object can be achieved by a fluid injector comprising a housing, a valve body and an actuator unit that is inserted into the housing, wherein the valve body comprises a cartridge with a recess that takes in a needle, a hollow body, which is arranged in a fixed position to the needle and forms a first spring rest, a valve cap which takes in the cartridge and forms a second spring rest, and a return spring, that rests on one hand on the first spring rest and on the other hand on the second spring rest, wherein the valve cap, the housing and the cartridge being formed such, that before the valve cap and the housing and the valve cap and the cartridge are permanently fixed to each other the valve cap is moveable relative to the housing and the cartridge while the housing and the cartridge stay in a fixed position relative to each other.

The valve cap or the cartridge may comprise a first sealing element, which seals the connection between the valve cap and the cartridge. The housing or the valve cap may comprise a second sealing element, which seals the connection between the housing and the valve cap. The valve cap may comprise a thread and the housing may comprise a corresponding thread and the valve cap being threaded into the thread of the housing.

The object may also be achieved by a method for manufacturing a fluid injector with a housing, a valve body and an actuator unit, that is inserted into the housing, with the valve body comprising a cartridge with a recess, that takes in a needle, a hollow body, which is arranged in a fixed position to the needle and forms a first spring rest, a valve cap, which takes in the cartridge and forms a second spring rest, a return spring, that rests on one hand on the first spring rest and on the other hand, on the second spring rest, with the valve cap, the housing and the cartridge being formed such, that before the valve cap and the housing and the valve cap and the cartridge are permanently fixed to each other the valve cap is moveable relative to the housing and the cartridge while the housing and the cartridge stay in a fixed position relative to each other, with the steps of calibrating the fluid flow characteristics of the fluid injector by moving the valve cap and thereafter permanently fixing the valve cap to the housing and to the cartridge.

The invention concerning the fluid injector is distinguished by a fluid injector with a housing, a valve body and an actuator unit that is inserted into the housing. The valve body comprises a cartridge with a recess that takes in a needle. The valve body further comprises a hollow body which is arranged in a fixed position to the needle and forms a first spring rest. The valve body further comprises a valve cap which takes in the cartridge and forms a second spring rest. A return spring rests on one hand on the first spring rest and on the other hand, on the second spring rest. The valve cap, the housing and the cartridge are being formed such that before the valve cap and the housing and the valve cap and the cartridge are permanently fixed to each other the valve cap is moveable relative to the housing and the cartridge, while the housing and the cartridge stay in a fixed relative position to each other. By moving the valve cap relative to the housing and the cartridge the pretension of the return spring may easily be set and in that way fluid flow characteristics of the fluid injector may easily be calibrated.

The invention concerning the method for manufacturing fluid injector is further distinguished by the steps of calibrating fluid flow characteristics of the fluid injector by moving the valve cap and permanently fixing the valve cap to the housing and to the cartridge after the calibration. In that way the pretension of the return spring can be changed during the calibration process without the need of dissembling the fluid injector. If the valve cap is moved during the calibration process relative to the housing and the cartridge in a transitory direction without a rotary movement, it can easily be assured that the rotational position of the needle and the cartridge stay the same. This ensures that areas of the needle and the cartridge, which have been brought into alignment by a grinding process, stay aligned, which prevents the buildup of coking during the operation of the fluid injector.

In an advantageous embodiment of the fluid injector the valve cap comprises a first sealing element, which seals the connection between the valve cap and the cartridge. In that way it can be ensured, that there is virtually no leakage in the area of the connection between the valve cap and the cartridge before the valve cap is permanently fixed to the housing and to the cartridge. That way the calibration process of the fluid injector can be performed quite precisely.

In a further advantageous embodiment of the fluid injector the housing comprises a second sealing element, which seals the connection between the housing and the valve cap. In that way it can easily be ensured, that there is virtually no leakage in the area of the connection between the housing and the valve cap before the valve cap is permanently fixed to the housing. That way the calibration process of the fluid injector can be performed quite precisely. In addition to that it may not be necessary to provide for a sealing of the connection between the housing and the valve cap by the permanent fixing process, which may be, for example, a welding operation.

In a further advantageous embodiment of the fluid injector the valve cap comprises a thread and the housing comprises a corresponding thread and the valve cap is threaded into the thread of the housing. In that way the axial position of the valve cap relative to the housing can be precisely changed during the calibration process. In this respect it is advantageous, if during the calibration process the cartridge and preferably the housing are fixed by a tool in their rotational position. In that way it can easily be assured that the rotational position of the needle and the cartridge stay the same. This ensures that areas of the needle and the cartridge, which have been brought into alignment by a grinding process, stay aligned, which prevents the buildup of coking during the operation of the fluid injector.

BRIEF DESCRIPTION OF THE DRAWINGS

Exemplary embodiments of the invention are explained in the following with the aid of schematic drawings. These are as follows.

DETAILED DESCRIPTION

Figure 1:
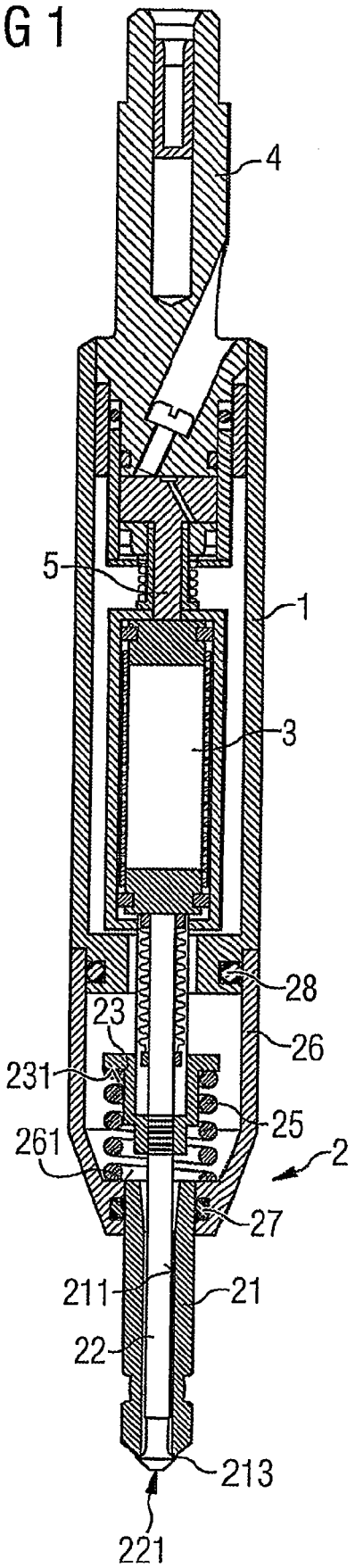
FIG. 1 a fluid injector.
Figure 2:
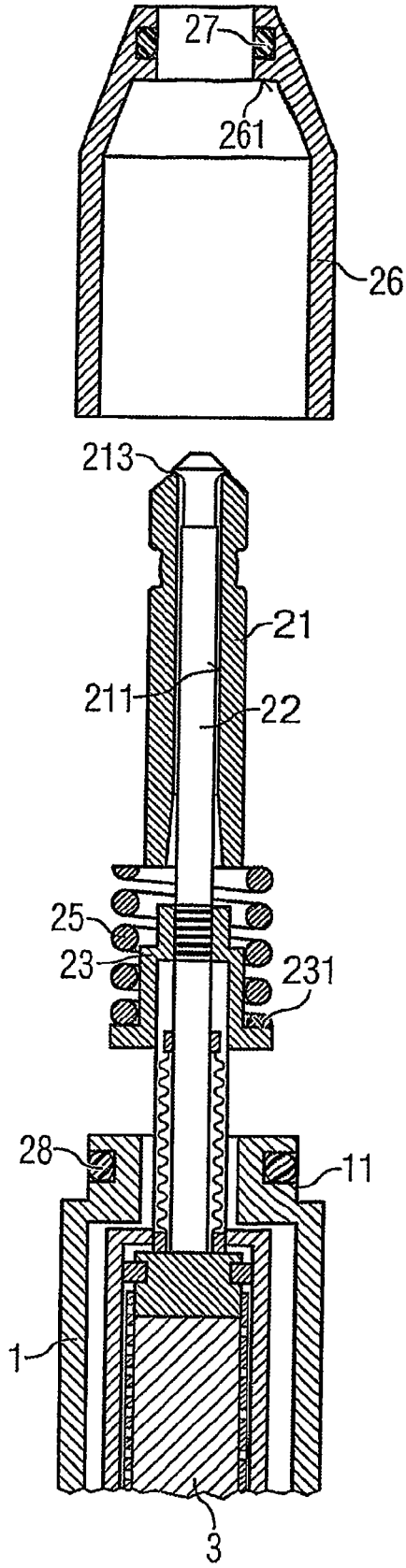
FIG. 2 parts of the unassembled fluid injector according to FIG. 1.

Elements of the same design and function that occur in different illustrations are identified by the same reference character.

A fluid injector (FIG. 1), that is used as a fluid injector for an internal combustion engine, comprises a housing 1, a valve body 2, an actuator unit 3, a fuel connector 4 and a thermal compensator 5. The fuel connector 4 is designed to be connected to a high pressure fuel chamber of the internal combustion engine, where fuel is stored under high pressure, for example under the pressure of about 200 Bar.

The housing 1 has a tubular shape. The fuel connector 4 is fixed to the housing 1 on one of the free ends of the housing 1. The thermal compensator is inserted into the housing 5 and contacts the actuator unit 3. The actuator unit 3 comprises in a preferred embodiment a piezo actuator, which changes its axial length depending on a control signal applied to it. The actuator unit 3 may, however, also comprise another type of actuator, which is known to a person skilled in the art for that purpose. Such an actuator may be, for example, a solenoid.

The fluid injector further comprises the valve body 2. The valve body 2 comprises a cartridge 21 with a recess 211, which is axially led through the cartridge 21. A needle 22 is taken in the recess 211 of the cartridge 21. On one of its free ends of the recess 211 an injection nozzle 213 is formed, which is closed or opened depending on the axial position of the needle 22.

The valve body further comprises a hollow body 23, which is preferably permanently fixed to the needle, for example by crimping. The hollow body 23 forms a first spring rest 231 for a return spring 25. A valve cap 26 forms a second spring rest 261. The return spring 25 is pretensioned between the first and second spring rest 231, 261. The way the return spring 25 is pretensioned is described in greater detail below.

The valve cap 26 takes in—at least part of—the cartridge 21. The cartridge 21 and the valve cap 26 are permanently fixed to each other, if the fluid injector is fully assembled. They are preferably fixed to each other by welding, preferably by laser-welding. On the other hand, the valve cap 26 is fixed to the housing 1. This fixation is preferably achieved by welding, in particular laser-welding.

Fuel is led from the fuel connector 4 around the actuator unit 3 towards the injection nozzle 213. The axial position of the needle 22, which determines whether the injection nozzle 213 is open or closed, depends on a force balance between the return spring 25 and the actuator unit 3. The fluid injector is designed as normally closed, that means if no control signals are applied to the actuator unit 3, the needle is pushed in its seat and by that closes the injection nozzle 3. If a respective control signal is applied to the actuator unit it changes its axial length and controls in that way, whether the injection nozzle 213 is opened or closed by the needle 22.

During the manufacturing process of the fluid injector the fuel connector 4, the thermal compensator 5 and the actuator unit 3 are inserted into the housing 1. The needle 22 is inserted into the recess 211 of the cartridge 21. After that the hollow body 23 is fixed in a given axial position to the needle 22. In this embodiment the hollow body 23 is crimped to the needle 22. The return spring 25 is pushed onto the hollow body 23 and rests on the first spring rest 231 of the hollow body. The needle 22 is brought into contact with the actuator unit 3. Preferably a bellow is welded on one of its free ends to the actuator unit 3 and on the other free end to the needle 22. After that the valve cap 26 is pushed over the cartridge 21 until it reaches a given axial position relative to the cartridge 21, where it sits on a guide 11 of the housing 1. It can then be axially moved relative to the housing 1 and the cartridge 21 while the housing 1 and the cartridge 21 stay in a fixed position relative to each other. A very tight connection between the valve cap 26 and the cartridge 21 can be achieved, if the valve cap 26 comprises a first sealing element 27, which is preferably and o-ring. The first sealing element 27 seals the connection between the valve cap 26 and the cartridge 21 in the area where the valve cap 26 and the cartridge 21 contact each other. In addition to that a second sealing element 28 is arranged in the housing in the area of the guide 11. In that way the connection between the housing 1 and the valve cap 26 is sealed tightly.

The fluid injector is in a next step connected to a fluid supply and is supplied with fluid, in particular fuel, under a given pressure. The actuator unit 3 may then be supplied with respective control signals and the amount of fuel, which is dosed by the fluid injector may be measured. If the actually supplied amount of fluid does not correspond to the intended amount of supplied fluid the axial position of the valve cap is changed. After that the actuator unit 3 is again supplied with control signals and the amount of fluid, which is then dosed by the fluid injector, is again measured and compared with a desired amount of fuel. These steps are repeated until the fluid injector doses the right amount of fluid by subsequently changing the axial position of the valve cap 26. By changing the axial position of the valve cap 26 the pretension of the return spring 25 is adjusted and in that way the fluid flow characteristics of the fluid injector are calibrated.

Alternative to measuring the actually dosed fluid and comparing it to a desired dosed fluid, also other physical properties of the fluid injectors may be measured and compared to respective desired values during the calibration process.

During the calibration process the valve cap 26 is moved relative to the housing 1 and the cartridge 21 in a transitory direction without a rotary movement relative to the cartridge 21 and preferably to the housing 1. In that way it is effectively prevented that the needle 22 and the cartridge 21 change their relative rotary position to each other. It is desirable to keep this relative rotary position because the cartridge 21 and the needle have preferably, in a previous step of the manufacturing process, been grinded together in order to ensure that the outer cone contour of the needle and the cartridge are precisely aligned. This prevents the build-up of coking, a relative rotary movement between the needle 22 and the cartridge 21 might cause areas of the cone-shaped outer areas to be no longer aligned which would then support the build-up of coking.

After the fluid flow characteristics of the fluid injector have been calibrated the valve cap 26 is permanently fixed to the housing and to the cartridge. This is preferably achieved by welding, in particular laser-welding. The welding may be such, that it tightly seals the connection between the valve cap 26 and the housing 1 and respectively the cartridge 21 or alternatively only parts of the circumference may be welded together, if already by the sealing elements 27 and/or 28 a long lasting tight sealing can be assured.

Figure 3:
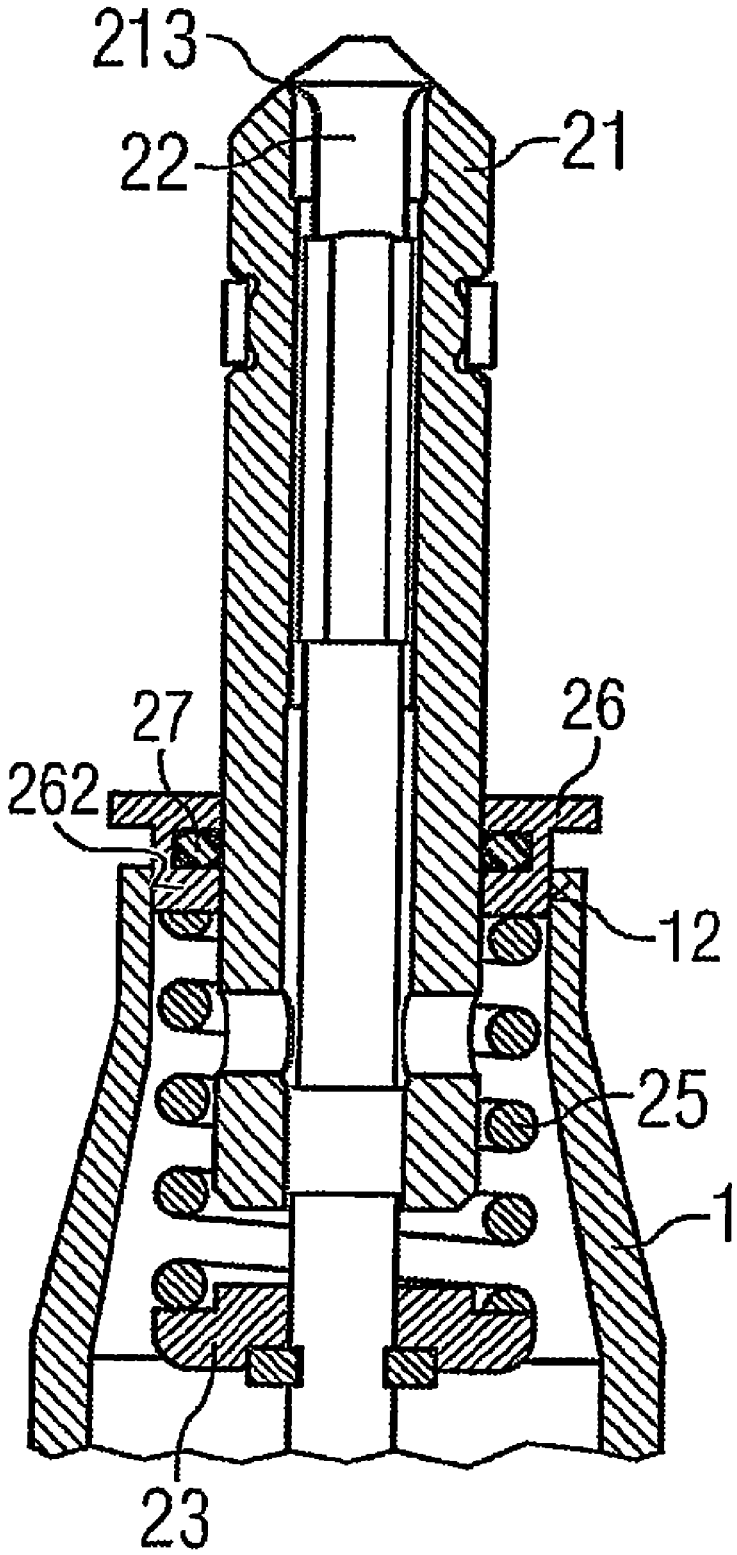
FIG. 3 another embodiment of the fluid injector according to FIG. 1.

In a further embodiment of the fluid injector (FIG. 3) the valve cap comprises a thread 262 and the housing 1 comprises a corresponding thread 12 and the valve cap 26 is threaded into the thread 12 of the housing 1.

During the calibration process the valve cap 26 is moved relative to the housing 1 and the cartridge 21 in a transitory direction by threading the valve cap 26 into the housing 1. Preferably the cartridge and preferably the housing are fixed by a tool in their rotational position during the calibration process. In that way it is effectively prevented that the needle 22 and the cartridge 21 change their relative rotary position to each other. It is desirable to keep this relative rotary position because the cartridge 21 and the needle have preferably, in a previous step of the manufacturing process, been grinded together in order to ensure that the outer cone contour of the needle and the cartridge are precisely aligned. The process for manufacturing corresponds respectively to the one for the first embodiment of the fluid injector.

In a simple embodiment of the fluid injector the first and/or second sealing elements 27, 28 may be omitted if the housing 1, the cartridge 21 and the valve cap 26 are manufactured so precisely, that without the first and second sealing elements 27, 28 virtually no leakage through the connections can be assured. They may also be omitted if a small fluid leakage during the calibration process is accepted. In a further alternative embodiment the cartridge 21 comprises the first sealing element 27 and/or the valve cap 26 comprises the second sealing element 28.

What is claimed is:

1. A fluid injector comprising:

a housing, a valve body, and an actuator unit that is inserted into the housing, wherein the valve body comprises:

a cartridge with a recess that takes in a needle, a hollow body, which is arranged in a fixed position to the needle and forms a first spring rest, a valve cap which takes in the cartridge and forms a second spring rest, a return spring, that rests on the first spring rest and on the second spring rest, a first axially extendable interface between the housing and the valve cap configured to allow axial extension at least during a calibration, a second axially extendable interface between the valve cap and the cartridge configured to allow axial extension at least during the calibration, a first seal maintained within the first axially extendable interface, and a second seal maintained within the second axially extendable interface, wherein the housing and the cartridge stay in a fixed position relative to each other during the calibration.

2. A fluid injector according to claim 1, wherein the valve cap or the cartridge comprises a first sealing element, which seals the connection between the valve cap and the cartridge.

3. A fluid injector according to claim 1, wherein the housing or the valve cap comprise a second sealing element, which seals the connection between the housing and the valve cap.

4. A fluid injector according to claim 1, wherein the valve cap comprises a thread and the housing comprises a corresponding thread and the valve cap being threaded into the thread of the housing.

5. The fluid injector of claim 1, wherein the first and second seals prevent substantial leakage of fluid from the fluid injector when fluid is introduced under expected operating conditions.

6. The fluid injector of claim 1, wherein the needle does not rotate within the cartridge as a result of axial movement between the valve cap and the housing or between the cartridge and the valve cap.

7. The fluid injector of claim 1, wherein the first or second axially extendable interface includes a gasket for maintaining the corresponding first or second seal within the axially extendable interface.

8. The fluid injector of claim 1, wherein the housing and the valve cap have been manufactured precisely to form a precise fit between the housing and the valve cap, which alone maintains the first seal within the first axially extendable interface.

9. A method for manufacturing a fluid injector with:

a housing, a valve body, and an actuator unit that is inserted into the housing, with the valve body comprising:

a cartridge with a recess that takes in a needle, a hollow body, which is arranged in a fixed position to the needle and forms a first spring rest, a valve cap, which takes in the cartridge and forms a second spring rest, a return spring, that rests on the first spring rest and on the second spring rest, a first axially extendable interface between the housing and the valve cap configured to allow axial extension at least during a calibration, a second axially extendable interface between the valve cap and the cartridge configured to allow axial extension at least during the calibration, a first seal maintained within the first axially extendable interface, and a second seal maintained within the second axially extendable interface, with the steps of:

calibrating the fluid flow characteristics of the fluid injector by moving the valve cap axially relative to the housing and the cartridge while maintaining first and second seal, and thereafter permanently fixing the valve cap to the housing and to the cartridge.

10. A fluid injector comprising:

a housing, an actuator unit arranged within the housing, a cartridge with a recess and a needle arranged in the recess, a hollow body arranged in a fixed position to the needle and forming a first spring rest, a valve cap in which the cartridge is arranged and forming a second spring rest, and a return spring resting on the first and second spring rest, a first axially extendable interface between the a cylindrical lower portion of the housing and an overlapping cylindrical upper portion of the valve cap configured to allow axial extension at least during a calibration, a second axially extendable interface between the valve cap and the cartridge configured to allow axial extension at least during the calibration, a first seal maintained within the first axially extendable interface, and a second seal maintained within the second axially extendable interface, wherein the housing and the cartridge stay in a fixed position relative to each other during the calibration.

11. A fluid injector according to claim 10, wherein the valve cap or the cartridge comprises a first sealing element, which seals the connection between the valve cap and the cartridge.

12. A fluid injector according to claim 10, wherein the housing or the valve cap comprise a second sealing element, which seals the connection between the housing and the valve cap.

13. A fluid injector according to claim 10, wherein the valve cap comprises a thread and the housing comprises a corresponding thread and the valve cap being threaded into the thread of the housing.

* * * * *